US008045895B2

(12) United States Patent
Matsumoto et al.

(10) Patent No.: US 8,045,895 B2
(45) Date of Patent: Oct. 25, 2011

(54) DEVELOPING DEVICE AND IMAGE FORMING DEVICE

(75) Inventors: Takuji Matsumoto, Saitama (JP); Kiyoshi Nagamine, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 410 days.

(21) Appl. No.: 12/409,946

(22) Filed: Mar. 24, 2009

(65) Prior Publication Data

US 2010/0098463 A1 Apr. 22, 2010

(30) Foreign Application Priority Data

Oct. 20, 2008 (JP) ..... 2008-270193

(51) Int. Cl.
*G03G 15/08* (2006.01)

(52) U.S. Cl. ..... 399/254; 399/258; 399/260

(58) Field of Classification Search ..... 399/107, 399/111, 113, 119, 120, 252–260
See application file for complete search history.

(56) References Cited

U.S. PATENT DOCUMENTS 5,012,285 A * 4/1991 Oka et al. ..... 399/260
7,720,405 B2 * 5/2010 Okabe ..... 399/90

FOREIGN PATENT DOCUMENTS

| | | |
|---|---|---|
| JP | 63-273890 | 11/1988 |
| JP | 2-025856 | 1/1990 |
| JP | 2003-57932 | 2/2003 |
| JP | 2006-276534 | 10/2006 |
| JP | 2008-015022 | 1/2008 |

* cited by examiner

*Primary Examiner* — Hoan Tran
(74) *Attorney, Agent, or Firm* — Morgan, Lewis & Bockius LLP

(57) ABSTRACT

A developing device has: a developer housing chamber in which developer is housed; a developer holding member holding developer by magnetic force; a partitioning wall having an overlapping region that, in a transparent plan view, is positioned upward of the developer holding member and overlaps the developer holding member in an up/down direction; and an opening portion formed in the overlapping region of the partitioning wall. The partitioning wall is a portion of a separating wall of the developer housing chamber, and is provided between the developer housing chamber and the developer holding member.

11 Claims, 9 Drawing Sheets

DEVELOPING DEVICE AND IMAGE FORMING DEVICE

CROSS-REFERENCE TO RELATED APPLICATION

This application is based on and claims priority under 35 USC 119 from Japanese Patent Application No. 2008-270193 filed Oct. 20, 2008.

BACKGROUND

1. Technical Field

The present invention relates to a developing device and an image forming device.

2. Related Art

In electrophotographic image forming devices, image formation is carried out by a latent image being formed on a photoreceptor or the like, and the latent image being made visible by a developer. The developer is housed within a developing device, and is conveyed toward the latent image due to rotation of a developing roller. When a two-component developer formed from toner and carrier is used as the developer, a developing roller is used that contains therein a magnetic roller at which plural magnetic poles are formed in advance. The developing roller draws the carrier to the outer peripheral surface and holds it thereat by magnetic force, and conveys the toner that is charged by friction with the carrier.

As an example of a developing device using a two-component developer, there is a structure in which the developer is stored in a developer storing chamber before the developing device is used.

As another example of a developing device using a two-component developer, there is a structure in which an opening portion is provided in a wall that partitions a developing chamber and a developer housing chamber, at a thin layer formation region on the periphery of a developing roller.

SUMMARY

The present invention provides a developing device and an image forming device that reduce the amount of developer that stops within a developer housing chamber, in a case in which a developer holding member and a partitioning wall of the developer housing chamber overlap above and below as seen in a transparent plan view.

According to an aspect of the present invention, a developing device have a developer housing chamber in which developer is housed, a developer holding member holding developer by magnetic force, a partitioning wall that is a portion of a separating wall of the developer housing chamber and is provided between the developer housing chamber and the developer holding member, the partitioning wall having an overlapping region that, in a transparent plan view, is positioned upward of the developer holding member and overlaps the developer holding member in an up/down direction, and an opening portion formed in the overlapping region of the partitioning wall.

BRIEF DESCRIPTION OF THE DRAWINGS

Exemplary embodiments of the present invention will be described in detail based on the following figures, wherein.

DETAILED DESCRIPTION

A first exemplary embodiment of a developing device and an image forming device of the present invention will be described on the basis of the drawings.

Figure 1:
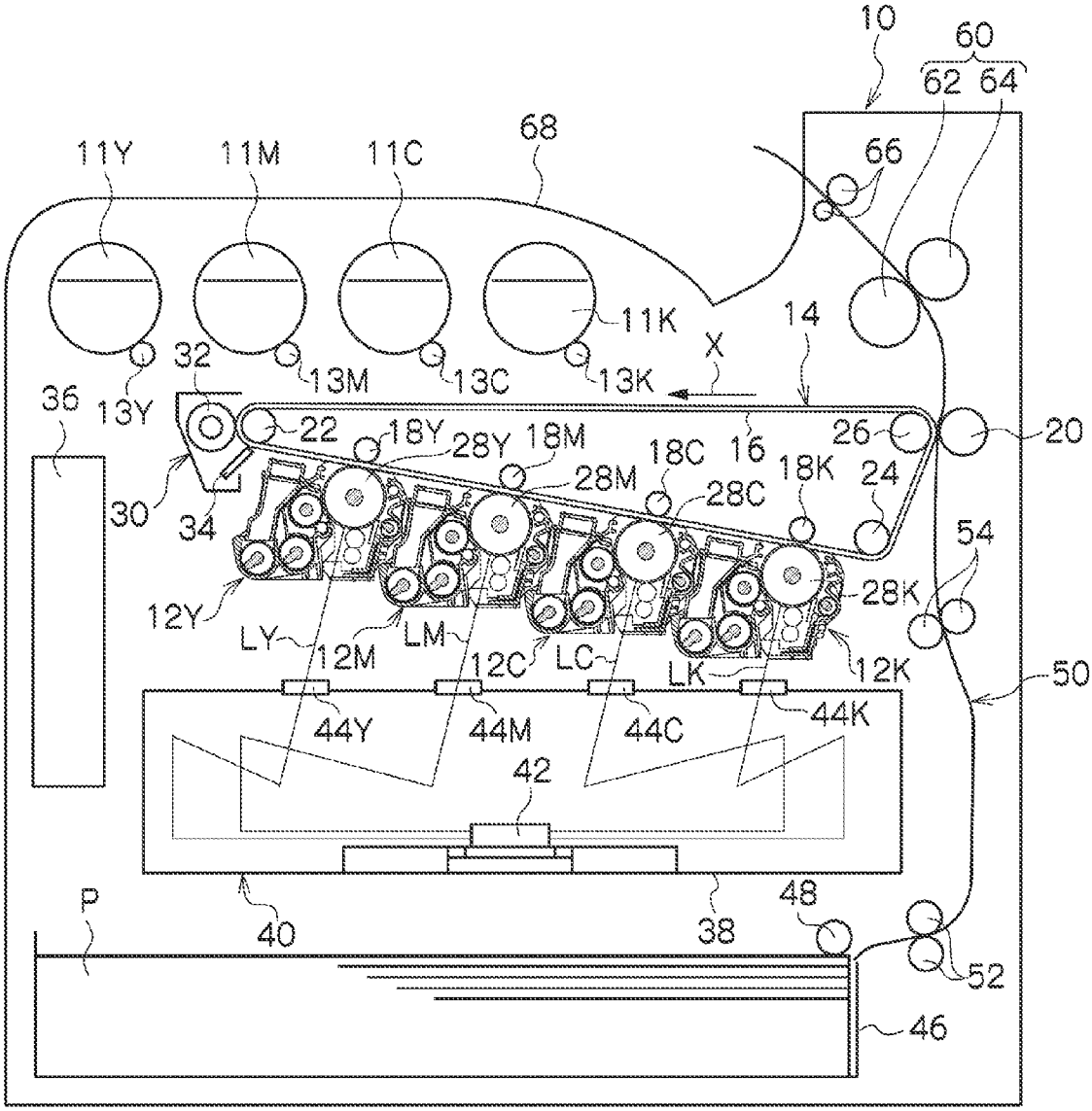
FIG. 1 is a side view schematically showing an image forming device relating to an exemplary embodiment of the present invention.

A printer 10 serving as an image forming device is shown in FIG. 1. The printer 10 is a digital printer that forms full-color images or black-and-white images, and an image processing device (not illustrated) is provided at the interior thereof. The image processing device carries out image processings on image data that is sent-in from a personal computer or the like.

Toner cartridges 11Y, 11M, 11C, 11K, that house yellow (Y), magenta (M), cyan (C) and black (K) toners respectively, are replaceably provided at the upper portion of the interior of the printer 10. Note that, in the following description, members corresponding to the respective colors of yellow, magenta, cyan, black are differentiated by Y, M, C, K being added to the reference numerals thereof.

Respective one ends of toner supply paths 13Y, 13M, 13C, 13K are connected to the toner cartridges 11Y, 11M, 11C, 11K, respectively. Note that the toner supply paths 13Y, 13M, 13C, 13K are structured by pipes and are disposed so as to be directed toward the lower side along a side surface of the printer 10, but illustration of the paths therealong is omitted.

Four image forming units 12 (12Y, 12M, 12C, 12K), that correspond to the Y, M, C, K developers, are disposed at the center of the printer 10 interior, in a state in which portions thereof overlap one another obliquely downward toward the right as seen in front view. The developers are mixtures of non-magnetic toners and magnetic carriers. Here, the other ends of the toner supply paths 13Y, 13M, 13C, 13K are connected to the four image forming units 12Y, 12M, 12C, 12K respectively, and the toners of the respective colors are supplied to the respective image forming units 12.

A transfer section 14 is provided above the image forming units 12Y, 12M, 12C, 12K. The transfer section 14 has: an intermediate transfer belt 16 that is an example of an intermediate transfer body; primary transfer rollers 18Y, 18M, 18C, 18K that are disposed at the inner side of the intermediate transfer belt 16 and serve as four primary transfer members that transfer, in a superposed manner, the respective toner images of the image forming units 12Y, 12M, 12C, 12K onto the intermediate transfer belt 16; and a secondary transfer roller 20 that transfers, onto a recording sheet P, the toner images that are superposed on the intermediate transfer belt 16.

The intermediate transfer belt 16 is trained, at a uniform tension, around a driving roller 22 that is driving by an unillustrated motor, a tension roller 24 that adjusts the tension of the intermediate transfer belt 16, and a back-up roller that is disposed so as to oppose the secondary transfer roller 20. The intermediate transfer belt 16 is driven and circulated in the direction of arrow X in FIG. 1 (counterclockwise) by the driving roller 22.

The primary transfer rollers 18Y, 18M, 18C, 18K are disposed so as to oppose photoreceptors 28 (28Y, 28M, 28C, 28K), that will be described later, of the image forming units 12Y, 12M, 12C, 12K, with the intermediate transfer belt 16 sandwiched therebetween. Further, transfer bias voltage of the polarity (positive polarity as an example in the present exemplary embodiment) that is opposite the toner polarity is applied to the primary transfer rollers 18Y, 18M, 18C, 18K by an electricity supplying unit (not shown). Note that transfer bias voltage of the polarity opposite the toner polarity is applied also to the secondary transfer roller 20 by the electricity supplying unit.

A cleaning device 30 is provided at the outer peripheral surface of the intermediate transfer belt 16 at the position where the driving roller 22 is provided. The cleaning device 30 has a cleaning brush 32 and a cleaning blade 34. The residual toner, paper dust, and the like on the intermediate transfer belt 16 are removed by the cleaning brush 32 and the cleaning blade 34.

A control unit 36, that carries out driving control of the respective sections of the printer 10, is provided in a vicinity of the side surface of the printer 10 at the side opposite the conveying path of the recording sheet P. Further, an exposure unit 40, that illuminates exposure lights L (LY, LM, LC, LK) corresponding to the respective colors onto the surfaces of the charged photoreceptors 28 and forms electrostatic latent images thereon, is provided at the lower side of the image forming units 12.

The exposure unit 40 is structured as a single unit that is used in common for the four image forming units 12Y, 12M, 12C, 12K. The exposure unit 40 is structured so as to modulate four semiconductor lasers (not shown) in accordance with color gradation data of the respective colors, and emit the exposure lights LY, LM, LC, LK from the semiconductor lasers in accordance with gradation data. Note that the exposure unit 40 may be provided separately for each of the image forming units 12.

The exposure unit 40 is tightly closed by a parallelepiped frame 38. An f-θ lens (not shown) and a polygon mirror 42, for scanning the respective exposure lights L in a main scanning direction, are provided at the interior of the exposure unit 40. Glass windows 44Y, 44M, 44C, 44K, that are for exiting of the four exposure lights LY, LM, LC, LK toward the photoreceptors 28 of the image forming units 12Y, 12M, 12C, 12K, are provided at the top surface of the frame 38.

Here, the exposure lights LY, LM, LC, LK, that exit from the semiconductor lasers of the exposure unit 40, are illuminated via the f-θ lens onto the polygon mirror 42, and are deflected and scanned by the polygon mirror 42. The exposure lights LY, LM, LC, LK, that are deflected and scanned at the polygon mirror 42, are, via an optical system (not shown) formed from an imaging lens and plural mirrors, scanned and exposed from obliquely beneath onto exposure points on the photoreceptors 28.

On the other hand, a sheet feed cassette 46 in which the recording sheets P are housed is disposed at the lower side of the exposure unit 40. A sheet conveying path 50 that conveys the recording sheet P is provided upward in a vertical direction from an end portion of the sheet feed cassette 46.

A sheet feed roller 48 that feeds the recording sheets P out from the sheet feed cassette 46, a roller pair 52 for sheet separating and conveying that feeds the recording sheets P out one-by-one, and sheet leading end aligning rollers 54 that match the conveying timing of the recording sheet P and the moving timing of the image on the intermediate transfer belt 16, are provided on the sheet conveying path 50. Here, the recording sheets P, that are successively fed-out from the sheet feed cassette 46 by the sheet feed roller 48, are, via the sheet conveying path 50, conveyed once to a secondary transfer position of the intermediate transfer belt 16 by the sheet leading end aligning rollers 54 that rotate intermittently, and are stopped thereat.

A fixing device 60 is provided above the second transfer roller 20. The fixing device 60 has a heating roller 62 that is heated and a pressure-applying roller 64 that press-contacts the heating roller 62. Here, the recording sheet P, onto which the toner image of the respective colors has been transferred by the secondary transfer roller 20, is fixed by the heat and pressure at the press-contact portion between the heating roller 62 and the pressure-applying roller 64. Further, the recording sheet P is discharged-out to a discharging section 68, that is provided at the upper portion of the printer 10, by sheet discharging rollers 66 that are an example of a discharging device that is provided at the conveying direction downstream side of the recording sheet P. The residual toner, the paper powder, and the like that are at the surface of the intermediate transfer belt 16, at which the secondary transfer process of the toner image is finished, are removed by the cleaning device 30.

The image forming units 12 will be described next. Here, as an example, the image forming unit 12M will be described. Note that, because the image forming units 12Y, 12C, 12K corresponding to the respective other colors have structures similar to that of the image forming unit 12M, description thereof is omitted. Further, the letter M will be omitted from the reference numerals of the respective structural members of the image forming unit 12M.

Figure 2:
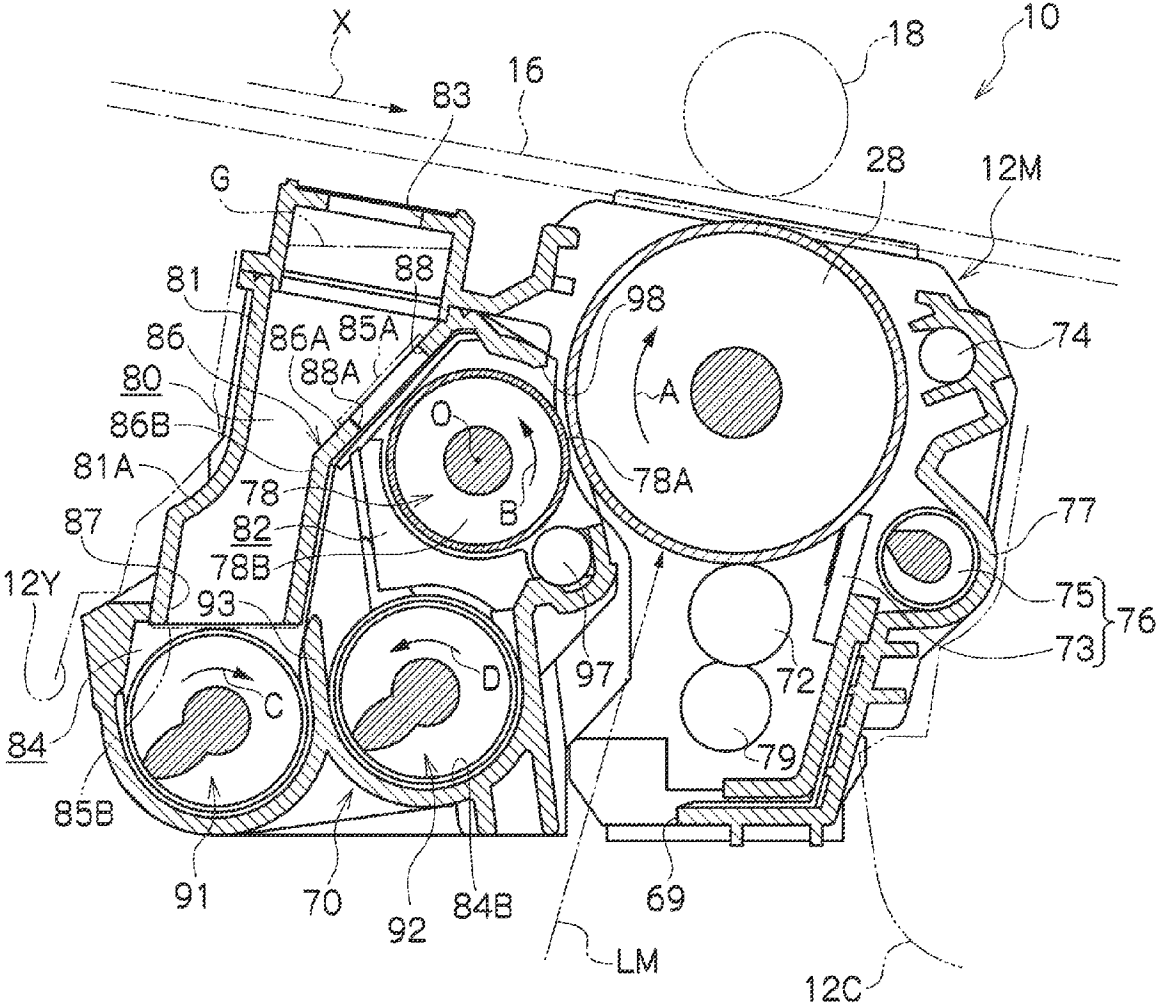
FIG. 2 is a cross-sectional view of an image forming unit relating to the exemplary embodiment of the present invention.

As shown in FIG. 2, the image forming unit 12 has the photoreceptor 28 that is driven to rotate in the direction of arrow A (clockwise). At the periphery of the photoreceptor 28 are provided: a charging roller 72 serving as an example of a charging device that contacts the surface of the photoreceptor 28 and charges the photoreceptor 28 uniformly; a developing section 70 developing the electrostatic latent image, that is formed on the photoreceptor 28 by the aforementioned exposure light L, by a developer (toner) of the corresponding color; an erase lamp 74 serving as an example of a charge-removing device that illuminates light onto the surface of the photoreceptor 28 after transfer and carries out charge removal; and a cleaning unit 76 that cleans the surface of the photoreceptor 28 after charge removal.

The charging roller 72, the developing section 70, the erase lamp 74 and the cleaning unit 76 are disposed so as to oppose the surface of the photoreceptor 28, in that order from the rotating direction upstream side of the photoreceptor 28 toward the downstream side.

The charging roller 72 is provided rotatably at the housing of the image forming unit 12, so as to be disposed lower, in the vertical direction, than a developing roller 78 that serves as a developer holding member of the developing section 70 and that will be described later. Further, a cleaning roller 79, that removes the toner and the like that adhere to the surface of the charging roller 72, is provided rotatably at the outer peripheral surface of the charging roller 72, at the side opposite the photoreceptor 28. Note that the charging roller 72 is connected to an unillustrated energizing means, and charges the surface of the photoreceptor 28 by being energized at the time of image formation.

The developing section 70 has: a developer housing chamber 80 that is disposed at the left end portion of the image forming unit 12M and in which developer G is filled; a developing chamber 82 provided between the developer housing chamber 80 and the photoreceptor 28, at the right side of the developer housing chamber 80; and a stirring/conveying chamber 84 provided at the lower side of the developer housing chamber 80 and the developing chamber 82, and stirring (mixing) the developer G that is supplied from the developer housing chamber 80, and conveying the developer to the developing chamber 82.

The developer housing chamber 80 is shaped as a box whose upper portion is inclined toward the photoreceptor 28 side, and a rectangular first opening portion 83 is formed in the upper portion thereof. The developer G (the line in the drawing shows the height of the top surface of the developer after filling) is made to flow-in and is filled-in into the interior in advance from the exterior via the first opening portion 83. Note that, after filling of the developer G, the first opening portion 83 is sealed by a sealing member (not shown).

A partitioning wall 86, that structures one surface of a separating wall of the developer housing chamber 80 and partitions the developer housing chamber 80 and the developing chamber 82, is provided between the developer housing chamber 80 and the developing chamber 82. Here, as shown in FIG. 4, the partitioning wall 86 has a region SA that overlaps the developing roller 78 as seen in a transparent plan view, namely as seen in a sectional view intersecting the axis of the photoreceptor 28.

Figure 4:
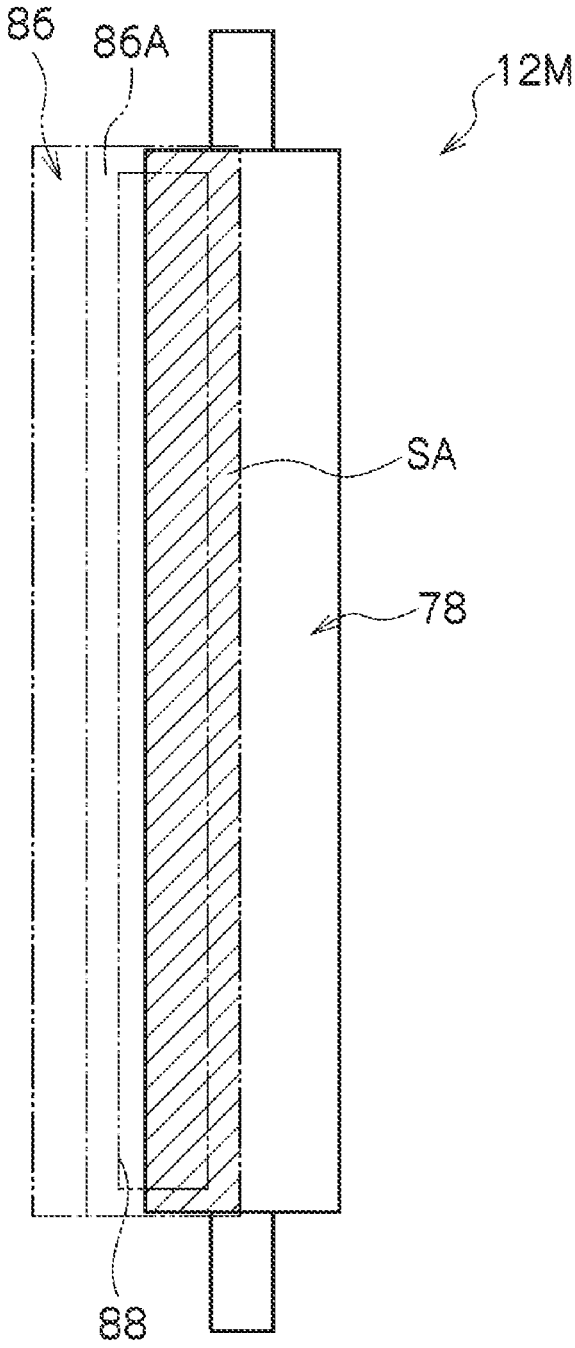
FIG. 4 is a schematic drawing showing a state of arrangement, as seen in a transparent plan view, of a developing roller and a partitioning wall relating to the exemplary embodiment of the present invention.

As shown in FIG. 2 and FIG. 4, an inclined portion 86A, that is inclined so as to approach the developing roller 78 of the developing chamber 82, is provided at the partitioning wall 86. A second opening portion 88, that is rectangular and whose longitudinal direction width is shorter than the longitudinal direction width of the developing roller 78, is formed in the inclined portion 86A. The developer housing chamber 80 and the developing chamber 82 communicate by the second opening portion 88.

As shown in FIG. 2, a lower edge portion 88A of the second opening portion 88 is disposed higher than a rotational center O of the developing roller 78. Due thereto, the amount of the developer G that flows-in from the developing chamber 82 into the developer housing chamber 80 can be reduced. Further, the interior region of the second opening portion 88 is partially positioned within the region SA.

Moreover, a wall portion 86B of the partitioning wall 86, that is at the lower side of the second opening portion 88, is bent in a substantial inverted-V-shape toward the direction of gravity more than the angle of inclination of the inclined portion 86A, such that the interval between the developing roller 78 and the wall portion 86B is wider than the interval between the developing roller 78 and the inclined portion 86A. Due thereto, the amount of the developer G, that has been peeled-off from the developing roller 78 and adheres to the developing roller 78 again, is reduced.

The developer housing chamber 80 has a side wall 81 that opposes the partitioning wall 86 and structures a side surface of the image forming unit 12M. A reduced diameter portion 81A, that is bent toward the inner side of the developer housing chamber 80, is formed at the side wall 81 so as to be a reduced diameter portion where the sectional surface area of the developer housing chamber 80 is reduced rather than the sectional surface area of the first opening portion 83. The reduced diameter portion 81A is positioned at the lower side, in the vertical direction, of the aforementioned portion of the wall portion 86B that is bent in a substantial inverted-V-shape. Due thereto, the widths of the plural developing devices overall can be narrowed as will be described later (see FIG. 3).

A rectangular third opening portion 87 is formed at the bottom portion of the developer housing chamber 80. The developer housing chamber 80 and the stirring/conveying chamber 84 communicate via the third opening portion 87. The developer G, that is filled (housed) in the developer housing chamber 80 and flows-down within the developer housing chamber 80, passes through the third opening portion 87 and flows into the stirring/conveying chamber 84.

The second opening portion 88 and the third opening portion 87 are sealed in advance by sealing members 85A, 85B, respectively. Before the image forming unit 12M is mounted to the printer 10, the second opening portion 88 and the third opening portion 87 are opened by the sealing members 85A, 85B being removed from one side surface of the image forming unit 12M. Accordingly, accompanying this removing operation by an operator, vibrations are applied to the developer G that is stopped in vicinities of the respective opening portions, and the developer G drops down from the second opening portion 88 and the third opening portion 87.

Figure 5:
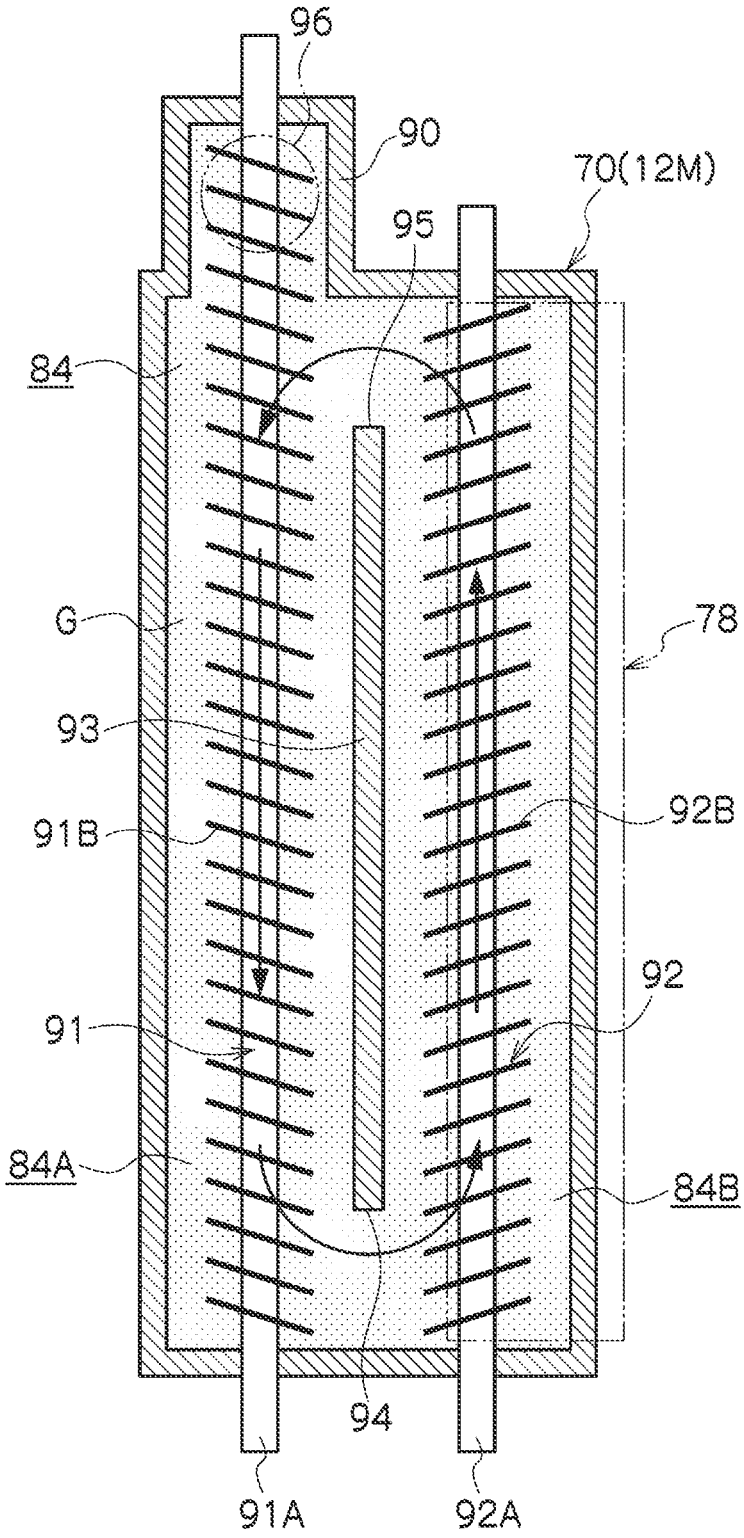
FIG. 5 is a cross-sectional view of a stirring/conveying chamber relating to the exemplary embodiment of the present invention.

As shown in FIG. 2 and FIG. 5, the stirring/conveying chamber 84 is partitioned by a partitioning wall 93 that stands erect from the bottom surface thereof, such that two stirring paths that are a first stirring path 84A and a second stirring path 84B are provided. A first communicating opening 94 and a second communicating opening 95 that are opened are formed at positions of the both end portions of the partitioning wall 93. The first stirring path 84A and the second stirring path 84B communicate by the first communicating opening 94 and the second communicating opening 95.

The top surface of the first stirring path 84A is open and the third opening portion 87 is disposed thereat, so that the first stirring path 84A communicates with the developer housing chamber 80. Further, the top surface of the second stirring path 84B is open and the developing roller 78 is disposed thereabove, so that the second stirring path 84B communicates with the developing chamber 82.

A projecting portion 90, that projects further toward the outer side than the end surface of the second stirring path 84B, is formed at one end of the first stirring path 84A (the deep side in the direction perpendicular to the surface of FIG. 2). A toner supply opening 96, to which the other end of the aforementioned toner supply path 13M (see FIG. 1) is connected, is formed at the top surface of the projecting portion 90. Due thereto, the toner of the toner cartridge 11M falls down through the toner supply path 13M and is supplied to the image forming unit 12M (the developing section 70).

A first stirring/conveying member 91 is disposed at the first stirring/conveying path 84A. The first stirring/conveying member 91 is structured by a first shaft portion 91A that is rotatably supported at the housing of the image forming unit 12M, and a first blade portion 91B that is spiral and provided at the periphery of the first shaft portion 91A. Similarly, a second stirring/conveying member 92 is disposed at the second stirring/conveying path 84B. The second stirring/conveying member 92 is structured by a second shaft portion 92A that is rotatably supported at the housing of the image forming unit 12M, and a second blade portion 92B that is spiral and provided at the periphery of the second shaft portion 92A.

The first shaft portion 91A and the second shaft portion 92A are driven by driving means formed from a motor and gears that are not illustrated. Here, the first shaft portion 91A rotates in the direction of arrow C, and the second shaft portion 92A rotates in the direction of arrow D (arrows C, D are different directions). Accordingly, the developer G within the stirring/conveying chamber 84 is mixed together with the supplied toner, and the developer G and the toner are conveyed through the interior of the first stirring path 84A and the interior of the second stirring path 84B while being stirred and mixed together. The developer G within the stirring/conveying chamber 84 circulates between the first stirring path 84A and the second stirring path 84B in the direction of the arrows (see FIG. 5).

As shown in FIG. 2, the lower portion of the developing chamber 82 communicates with the second stirring path 84B, and a fourth opening portion 98 is formed in the side wall of the developing chamber 82 which side wall is at the photoreceptor 28 side. The developing roller 78, whose axial direction is the longitudinal direction of the photoreceptor 28 and that rotates in the direction of arrow B (counterclockwise), is provided in the developing chamber 82. Further, a thin layer forming roller 97 serving as a layer restricting member is provided in the developing chamber 82.

The thin layer forming roller 97 is disposed at the upstream side of the photoreceptor 28 in the direction of rotation of the developing roller 78, with an interval between the thin layer forming roller 97 and the outer peripheral surface of the developing roller 78. The thin layer forming roller 97 restricts the passing amount of the developer G on the developing roller 78, and forms a developer layer (thin layer) of a predetermined thickness on the developing roller 78.

The developing roller 78 is disposed so as to oppose the outer peripheral surface of the photoreceptor 28 via the fourth opening portion 98 that is formed at the developing chamber 82. Further, the developing roller 78 is structured by a magnetic roller 78B serving as a magnetic field generating member that is fixed to the developing chamber 82, and a developing sleeve 78A that is shaped as a hollow cylinder and serves as a tubular rotating body that is rotatably provided at the outer periphery of the magnetic roller 78B. Note that bias voltage is applied and a magnetic field is formed between the developing roller 78 and the photoreceptor 28, and the toner within the developer G is moved toward the latent image of the photoreceptor 28 at the time of development.

Figure 6A:
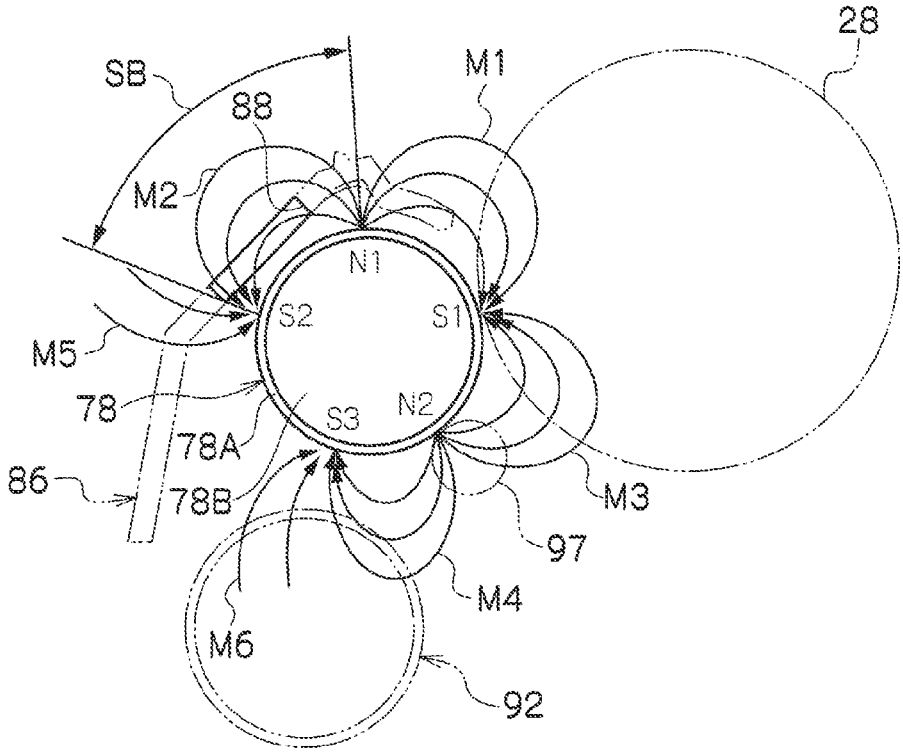
FIG. 6A is a schematic drawing showing magnetic force lines of the developing roller relating to the exemplary embodiment of the present invention.

As shown in FIG. 6A, a developing magnetic pole portion S1 that faces the photoreceptor 28 and holds the developer G (that is not shown in FIG. 6A and FIG. 6B), a conveying magnetic pole portion N1 that is a different polarity than the developing magnetic pole portion S1 and that draws the developer of the developing magnetic pole portion S1, and a peeling magnetic pole portion S2 that is the same polarity as the developing magnetic pole portion S1 and that peels-off the developer G that is drawn to the conveying magnetic pole portion N1, are provided at the magnetic roller 78B of the developing roller 78.

Further, an attracting magnetic pole portion S3 that is the same polarity as the peeling magnetic pole portion S2 and that attracts the developer G that is conveyed by the second stirring/conveying member 92, and a layer forming magnetic pole portion N2 that is a different polarity than the attracting magnetic pole portion S3 and is for forming a thin layer by the thin layer forming roller 97, are provided at the magnetic roller 78B.

The developing magnetic pole portion S1 is disposed at the position closest to the photoreceptor 28. The conveying magnetic pole portion N1 is disposed at the downstream side of the developing magnetic pole portion S1 in the rotating direction of the developing sleeve 78A, at a position that is at the uppermost side of the developing roller 78 in the vertical direction. The peeling magnetic pole portion S2 is disposed at a position opposing the second opening portion 88, and the attracting magnetic pole portion S3 is disposed at a position near to the second stirring/conveying member 92. The layer forming magnetic pole portion N2 is disposed at a position opposing the thin layer forming roller 97.

A magnetic field M1 is formed from the conveying magnetic pole portion N1 toward the developing magnetic pole portion S1, and a magnetic field M2 is formed from the conveying magnetic pole portion N1 toward the peeling magnetic pole portion S2. Further, a magnetic field M3 is formed from the layer forming magnetic pole portion N2 toward the developing magnetic pole portion S1, and a magnetic field M4 is formed from the layer forming magnetic pole portion N2 toward the attracting magnetic pole portion S3. Note that, because the peeling magnetic pole portion S2 and the attracting magnetic pole portion S3 are the same polarity, at the region between the peeling magnetic pole portion S2 and the attracting magnetic pole portion S3, the developer G on the developing sleeve 78A is peeled-off due to the repulsion force between a magnetic field M5 that is directed toward the peeling magnetic pole portion S2 and a magnetic field M6 that is directed toward the attracting magnetic pole portion S3.

Figure 6B:
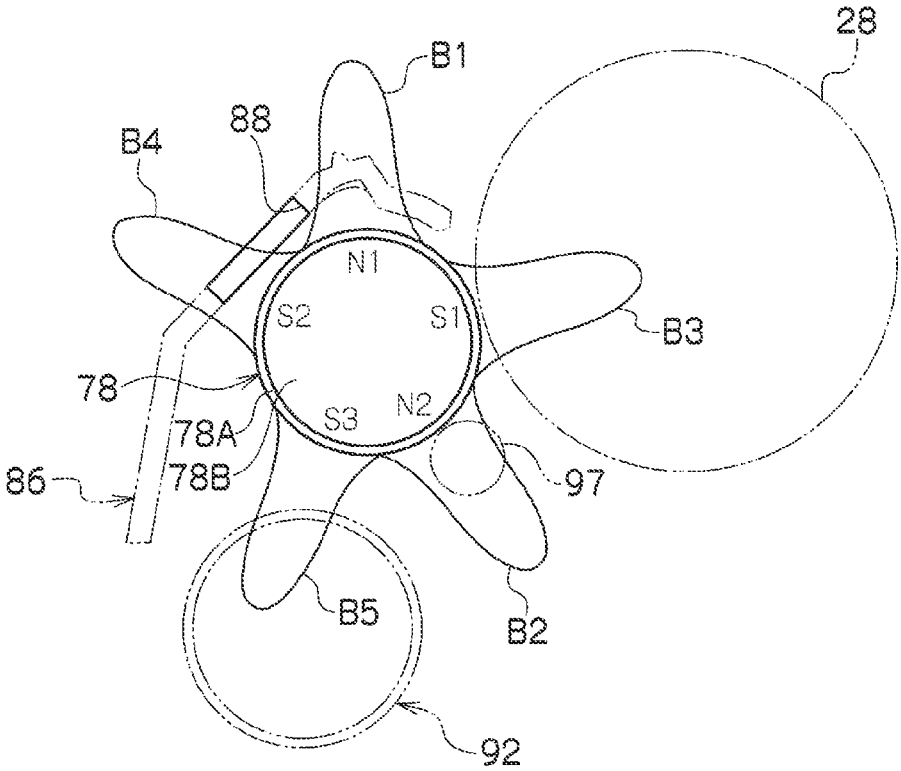
FIG. 6B is a schematic drawing showing the intensity distribution of magnetic flux density of the developing roller relating to the exemplary embodiment of the present invention.

Further, as shown in FIG. 6B, at the developing roller 78, regions B1, B4, B5, B2, B3, where the respective magnetic flux densities are the highest, are positioned in the radial directions of the conveying magnetic pole portion N1, the peeling magnetic pole portion S2, the attracting magnetic pole portion S3, the layer forming magnetic pole portion N2 and the developing magnetic pole portion S1 at the magnetic roller 78B.

Here, as shown in FIG. 6A and FIG. 6B, the second opening portion 88 is positioned at a region SB that faces the region from the conveying magnetic pole portion N1 to the peeling magnetic pole portion S2, and is positioned at the region B4 where the magnetic flux density of the peeling magnetic pole portion S2 is highest. Note that, as shown in FIG. 6A and FIG. 6B, a portion of the opening of the second opening portion 88 may be disposed at the region SB and the region B4, or the entire opening may be disposed thereat.

On the other hand, as shown in FIG. 2, the cleaning unit 76 of the image forming unit 12M has a cleaning blade 73 and a conveying member 75. The cleaning blade 73 contacts the surface of the photoreceptor 28 at a contact angle, and scrapes-off the transfer residual toner and the like. Further, the conveying member 75 is disposed at the back surface side of the cleaning blade 73, and discharges the transfer residual toner and the like, that are scraped-off by the cleaning blade 73, to a waste toner box (not shown).

A space for exposure is formed at the lower side of the photoreceptor 28 of the image forming unit 12M, at the left side of the charging roller 72 and the cleaning roller 79. An opening portion 69 for exposure is formed in the floor surface of the image forming unit 12M, at the portion that is positioned at the lower side of this space for exposure. Due thereto, the exposure light LM can pass through the opening portion 69 for exposure and be illuminated onto the surface of the photoreceptor 28.

Figure 3:
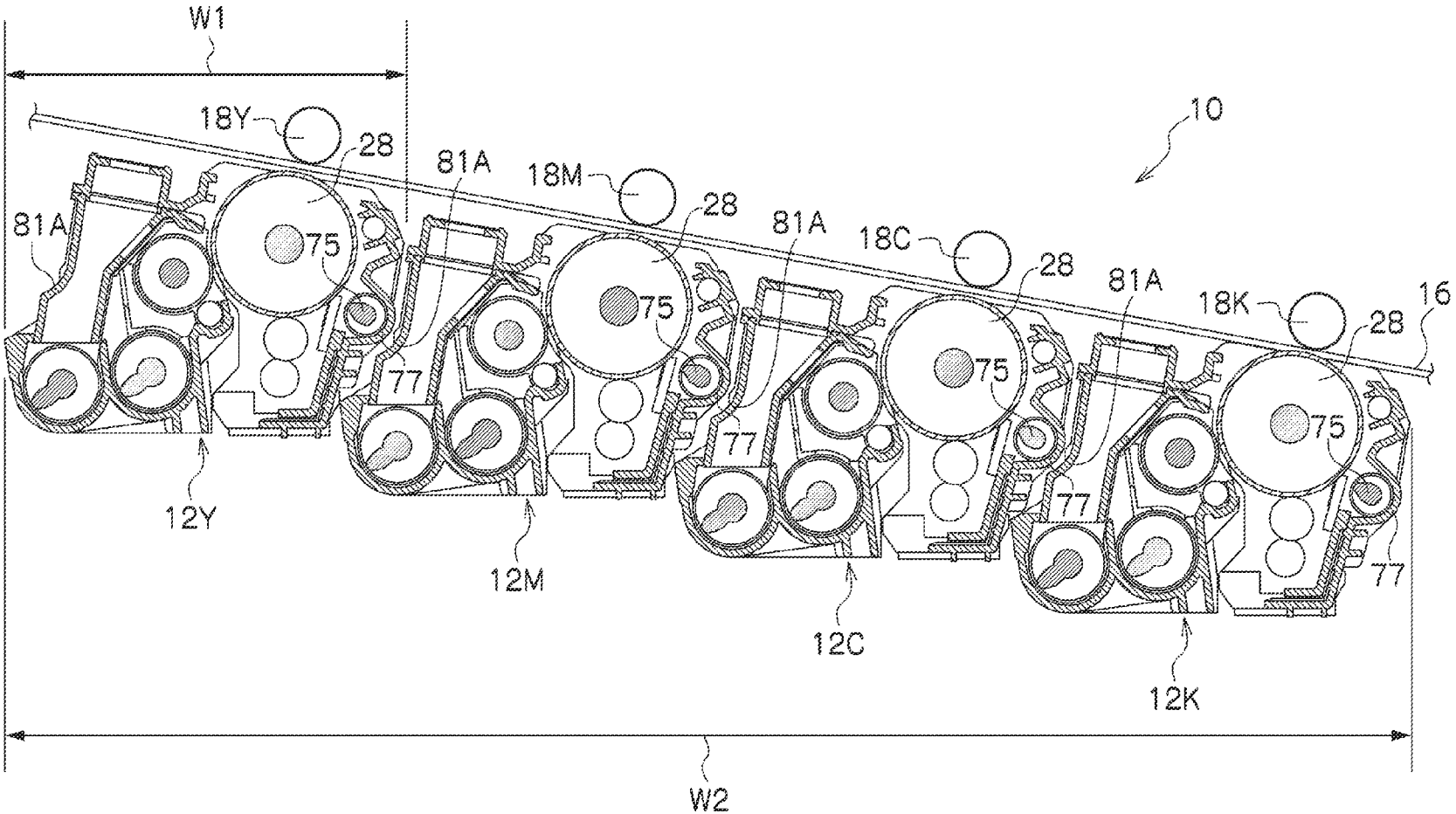
FIG. 3 is a side view showing a state of arrangement of plural image forming units relating to the exemplary embodiment of the present invention.

A state in which the image forming units 12Y, 12M, 12C, 12K are mounted to the interior of the printer 10 is shown in FIG. 3. Note that reference numerals of some of the members are omitted. Here, at the reduced diameter portion 81A of each image forming unit 12, there is disposed a right side wall 77 of the portion where the conveying member 75 of the adjacent image forming unit 12 is disposed. Namely, the adjacent image forming units 12 are disposed so as to overlap in the horizontal direction. Therefore, given that the lateral width of each image forming unit 12 is W1 and the overall lateral width of the image forming units 12Y, 12M, 12C, 12K mounted to the printer 10 is W2, there is the relationship W2<(4×W1). The placement space in the horizontal direction is small as compared with a case in which four of the image forming units 12 are merely arranged in a row.

The image forming processes of the printer 10 will be described next.

As shown in FIG. 1, image data that has been subjected to image processing at the image processing device (not shown) is converted into color gradation data of the four colors of yellow (Y), magenta (M), cyan (C) and black (K), and is successively outputted to the exposure unit 40. At the exposure unit 40, the respective exposure lights L are emitted in accordance with the color gradation data of the respective colors, scanning/exposure is carried out on the respective photoreceptors 28, and latent images (electrostatic latent images) are formed thereon.

As shown in FIG. 1 and FIG. 2, developing is carried out by the developing section 70 such that the electrostatic latent images, that are formed on the photoreceptors 28, are made visible as toner images (developer images) of the colors of yellow (Y), magenta (M), cyan (C) and black (K), respectively. Then, the toner images of the respective colors, that are successively formed on the photoreceptors 28 of the image forming units 12Y, 12M, 12C, 12K, are successively transferred in a superposed manner onto the intermediate transfer belt 16 by the four primary transfer rollers 18Y, 18M, 18C, 18K.

The toner image of the respective colors, that has been transferred in a superposed manner onto the intermediate transfer belt 16, is secondarily transferred by the secondary transfer roller 20 onto the recording sheet P that is conveyed-in. Then, the toner image of the respective colors on the recording sheet P is fixed at the fixing device 60, and the recording sheet P after fixing is discharged-out to the discharge tray 68.

Residual toner, paper powder, and the like are removed by the cleaning units 76 from the surfaces of the photoreceptors 28 after the transfer processes of the toner images are completed. Further, the residual toner, the paper powder and the like on the intermediate transfer belt 16 are removed at the cleaning device 30.

Operation of the exemplary embodiment of the present invention will be described next.

Figure 7A:
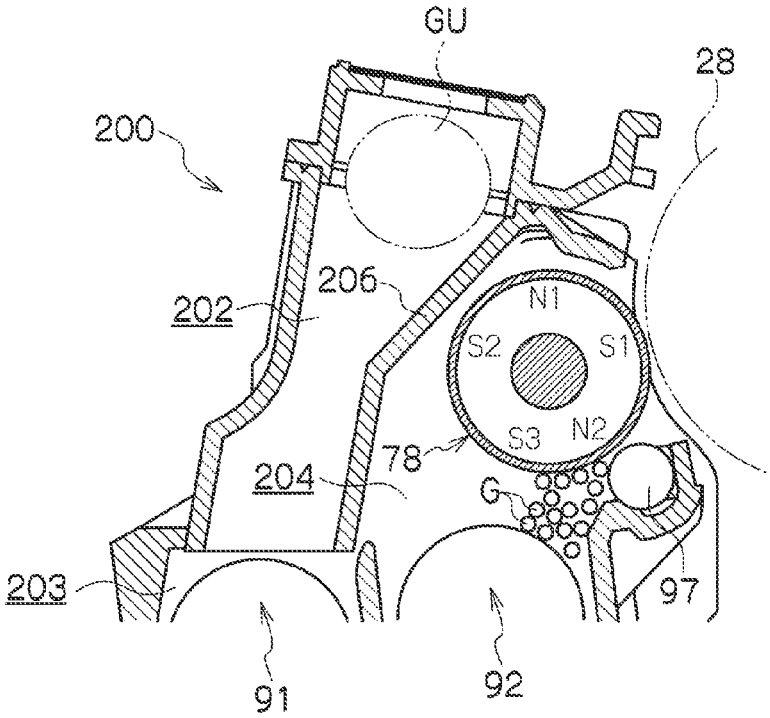
FIG. 7A is a schematic drawing showing a downward flowing state of developer within an image forming unit of a comparative example of the present invention.
Figure 7B:
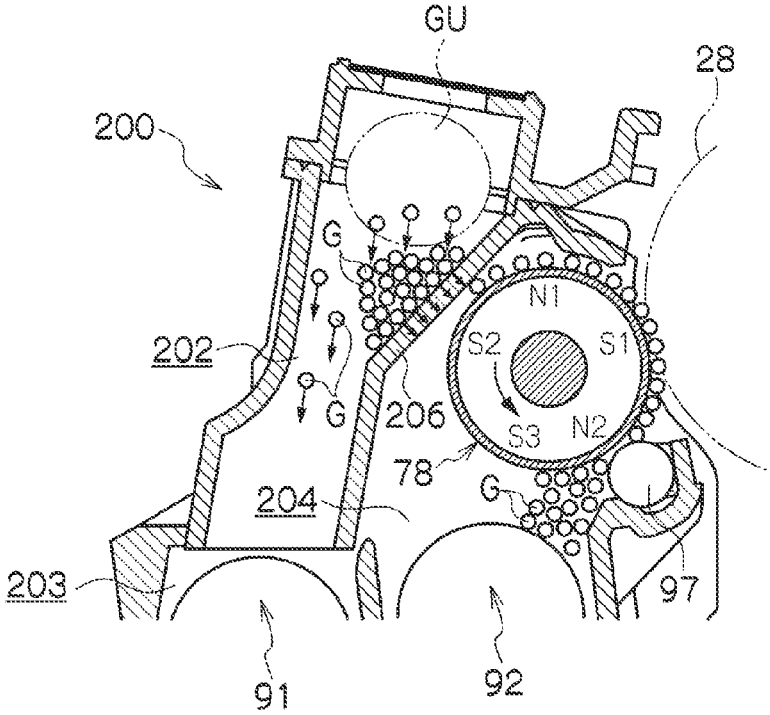
FIG. 7B is a schematic drawing showing a downward flowing state of developer within the image forming unit of the comparative example of the present invention.

An image forming unit 200 is shown in FIG. 7A and FIG. 7B as a comparative example of the image forming unit 12 of the present exemplary embodiment. Note that, in order to make the portions of comparison with the image forming unit 12 clear, description will be given with similar reference numerals as those of the image forming unit 12 given to some of the structural members of the image forming unit 200. Further, the developer G is actually fine particles and is in a bristle-like state at the outer periphery of the developing roller 78. However, to facilitate explanation hereinafter, the developer G is all shown by circles of the same diameter, regardless of the presence/absence of bristles.

As shown in FIG. 7A, provided at the image forming unit 200 are: a developer housing chamber 202 that houses the developer G; a stirring/conveying chamber 203 that stirs and conveys the developer G that flows down from the developer housing chamber; and a developing chamber 204 that conveys the developer G, that is supplied from the stirring/conveying chamber 203, to the surface of the photoreceptor 28 and carries out developing. A partitioning wall 206 is provided between the developer housing chamber 202 and the developing chamber 204. The partitioning wall 206 is provided in a vicinity of the developing roller 78, but no opening portion is formed therein.

Here, it is assumed that the developer G stays at the upper portion of the developer housing chamber 202 (e.g., further upward than the developing roller 78) due to shaking and the like at the time of transporting the image forming unit 200. This lump of the developer G is called developer GU.

Next, as shown in FIG. 7B, when the image forming unit 200 is mounted in the printer 10 (See FIG. 1), the developer G in the developer GU flows-down through the interior of the developer housing chamber 202 due to its own weight, and some of the developer G flows-down along the partitioning wall 206. Accordingly, due to the partitioning wall 206 having an inclined surface, it is easy for the developer G that is flowing-down to stop at the inclined surface. Further, here, because the partitioning wall 206 is disposed in a vicinity of the developing roller 78, the magnetic force of the developing roller 78 acts on the developer G that is flowing-down along the partitioning wall 206.

Because the carrier that is magnetic is contained in the developer G, some of the developer G is drawn toward the developing roller 78 and held, and accumulates on the partitioning wall 206. The interior of the developer housing chamber 202 is gradually blocked by the accumulated developer G, and therefore, it becomes difficult for the developer G that is above to flow-down to the stirring/conveying chamber 203. Further, in the stirring/conveying chamber 203, the needed amount of the developer G is insufficient, and the amount of toner needed for developing the latent image on the photoreceptor 28 is insufficient.

Figure 8A:
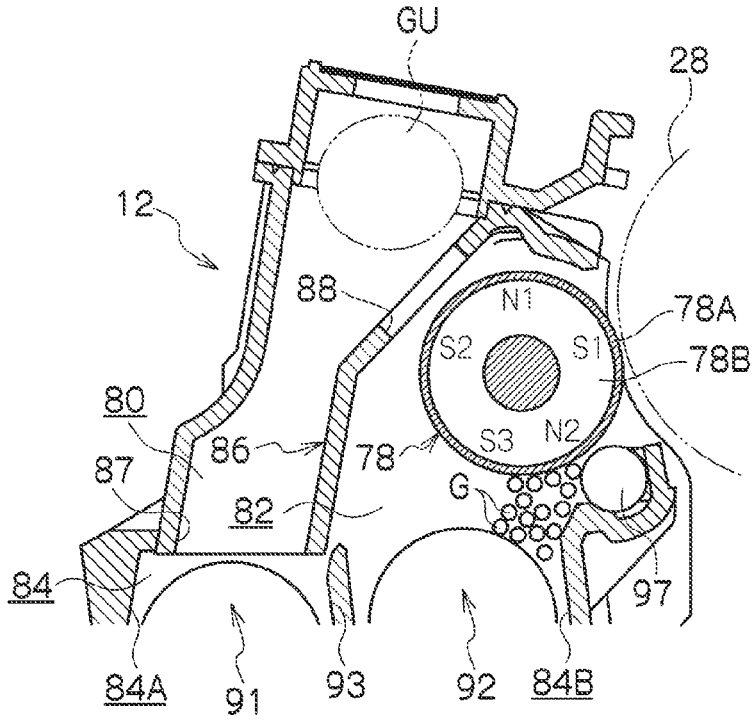
FIG. 8A is a schematic drawing showing a downward flowing state of developer within the image forming unit relating to the exemplary embodiment of the present invention.

On the other hand, as shown in FIG. 8A, in the image forming unit 12 of the present exemplary embodiment, it is assumed that there is the developer GU, that is a lump of the developer G, at the upper portion of the developer housing chamber 80 (e.g., further upward than the developing roller 78) due to shaking and the like during transporting.

Figure 8B:
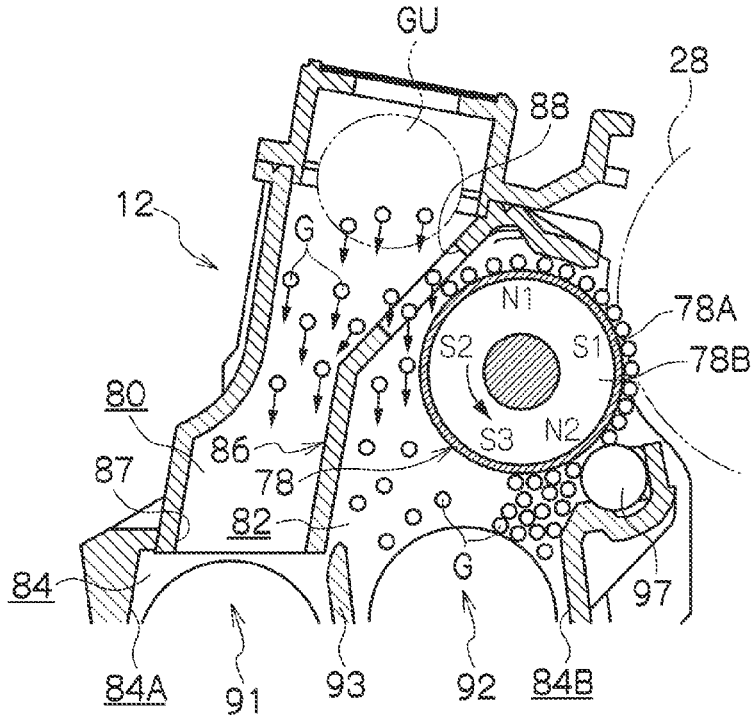
FIG. 8B is a schematic drawing showing a downward flowing state of developer within the image forming unit relating to the exemplary embodiment of the present invention.

Then, as shown in FIG. 8B, when the image forming unit 12 is mounted in the printer 10 (see FIG. 1), the developer G in the developer GU flows-down within the developer housing chamber 80 due to its own weight, and some of the developer G flows-down along the partitioning wall 86. Accordingly, due to the second opening portion 88 being formed, it is easy for the developer G to flow-down even if the partitioning wall 206 has an inclined surface. Further, here, because the partitioning wall 86 is disposed in a vicinity of the developing roller 78, the magnetic force of the developing roller 78 acts on the developer G that is flowing-down along the partitioning wall 86.

Because the carrier that is magnetic is contained in the developer G, some of the developer G is drawn toward the developing roller 78. Then, the drawn developer G passes through the second opening portion 88 and enters into the developing chamber 82, and falls down into the second stirring path 84B. Some of the developer G, that falls down into the second stirring path 84B, is used in developing due to the rotation of the developing roller 78, and the remainder is circulated and conveyed to the first stirring path.

Here, the second opening portion 88 is provided at the region SB (see FIG. 6A) that opposes the region from the conveying magnetic pole portion N1 to the peeling magnetic pole portion S2, and at the region B4 (see FIG. 6B) where the magnetic flux density is the highest. Therefore, the majority of the developer G that is flowing-down along the partitioning wall 86 is drawn toward the developing roller 78 by the magnetic field M2 (see FIG. 6A), and passes through the second opening portion 88 and flows into the developing chamber 82.

Because the majority of the developer G, that is drawn to the developing roller 78 in this way, passes through the second opening portion 88 and moves to the developing chamber 82, accumulation of the developer G on the partitioning wall 86 is eliminated. Further, the developer GU falls down into either of the developing chamber 82 and the stirring/conveying chambers 84, and all of it can be used in developing. Namely, as compared with the image forming unit 200 of the comparative example (FIG. 7A and FIG. 7B), the amount of developer that stops within the developer housing chamber can be reduced in the image forming unit 12 of the present exemplary embodiment.

Figure 9A:
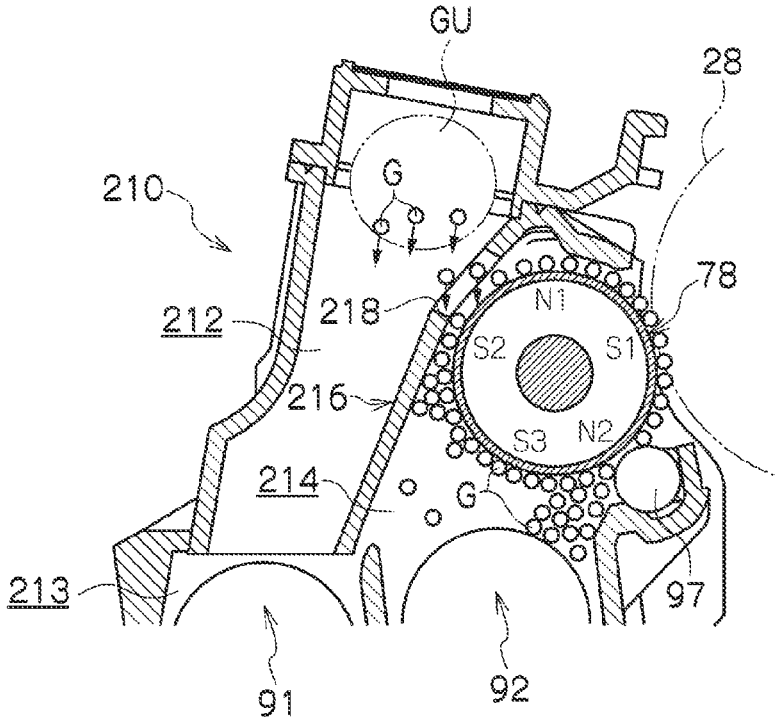
FIG. 9A is a schematic drawing showing a downward flowing state of developer within an image forming unit relating to a second exemplary embodiment of the present invention.

An image forming unit 210 is illustrated in FIG. 9A as a second exemplary embodiment of the image forming unit 12 of the present exemplary embodiment. Note that, in order to make the portions of comparison with the image forming unit 12 clear, description will be given with similar reference numerals as those of the image forming unit 12 given to some of the structural members of the image forming unit 210. Further the developer G is actually fine particles and is in a bristle-like state at the outer periphery of the developing roller 78. However, to facilitate explanation hereinafter, the developer G is all shown by circles of the same diameter, regardless of the presence/absence of bristles.

As shown in FIG. 9A, the image forming unit 210 is provided with: a developer housing chamber 212 that houses the developer G; a stirring/conveying chamber 213 that stirs and conveys the developer G that flows-down from the developer housing chamber; and a developing chamber 214 that conveys the developer G, that is supplied from the stirring/conveying chamber 213, to the surface of the photoreceptor 28 and carries out developing. A partitioning wall 216 is provided between the developer housing chamber 212 and the developing chamber 214. The partitioning wall 216 is provided in a vicinity of the developing roller 78. An opening portion 218 is formed in a position of the partitioning wall 216 which position is in a vicinity of the developing roller 78. The portion of the partitioning wall 216 that is at the lower side of the opening portion 218 is rectilinear.

Here, it is assumed that the developer G stays at the upper portion of the developer housing chamber 212 (e.g., further upward than the developing roller 78) due to shaking and the like at the time of transporting the image forming unit 210. This lump of the developer G is called the developer GU.

When the image forming unit 210 is mounted in the printer 10 (see FIG. 1), the developer G in the developer GU flows-down within the developer housing chamber 212 due to its own weight, and some of the developer G flows-down along the partitioning wall 216. Here, because the partitioning wall 216 is disposed in a vicinity of the developing roller 78, the magnetic force of the developing roller 78 acts on the developer G that is flowing-down along the partitioning wall 216.

Because the carrier that is magnetic is contained in the developer G, some of the developer G is drawn toward the developing roller 78. Because the majority of the drawn developer G passes through the opening portion 218 and flows into the developing chamber 214, it is difficult for the interior of the developer housing chamber 212 to become blocked by the developer G.

The developer G, that passes through the opening portion 218 and flows into the developing chamber 214, starts to fall downward due to its own weight. Here, the portion of the partitioning wall 216 at the lower side of the opening portion 218 is rectilinear, and the gap between the developing roller 78 and the partitioning wall 216 is narrow. Therefore, it is easy for the developer G that falls down from the opening 218 to be nipped between the partitioning wall 216 and the developing roller 78 and to receive pressure. However, the amount of the developer that stops in the developer housing chamber 212 is small as compared with a case in which the opening portion 218 is not provided in the partitioning wall 216.

Figure 9B:
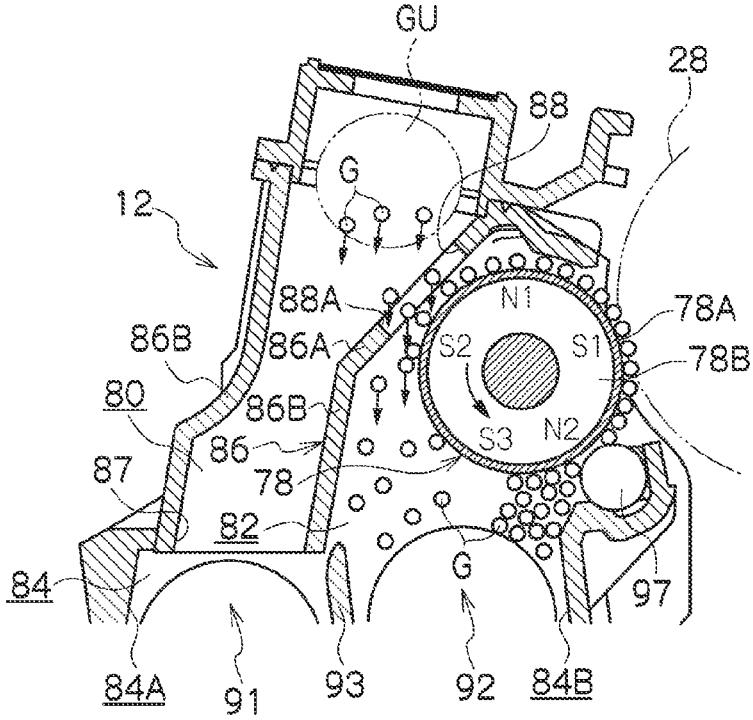
FIG. 9B is a schematic drawing showing a downward flowing state of developer within the image forming unit relating to the exemplary embodiment of the present invention.

On the other hand, as shown in FIG. 9B, in the image forming unit 12 of the first present exemplary embodiment, the portion of the partitioning wall 86 that is at the lower side of the second opening portion 88 is bent toward the direction of gravity more than the inclined angle of the inclined portion 86A, and the gap (space) between the partitioning wall 86 and the developing roller 78 is wide. Therefore, the developer G that falls down from the second opening portion 88 falls down without hardly being nipped at all between the partitioning wall 86 and the developing roller 78. The developer G after developing, that is held at the outer periphery of the developing roller 78, i.e., the outer periphery of the developing sleeve 78A, is peeled-off from the developing roller 78 between the peeling magnetic pole portion S2 and the attracting magnetic pole portion S3 due to the rotation of the developing roller 78. Due thereto, in the developing region between the developing roller 78 and the photoreceptor 28, the unused developer G is used, and the amount of toner that can be used in developing is a sufficient amount.

Note that, as shown in FIG. 2, at the image forming unit 12, the entire second opening portion 88 is disposed further upward than the rotational center of the developing roller 78. Therefore, when the developing roller 78 rotates in the direction of the arrow, the partitioning wall 86 becomes an obstacle to the movement of the developer G Due thereto, it is difficult for the developer G after developing, that is held at the developing roller 78, to pass through the second opening portion 88 and flow into the developer housing chamber 80, and the developer G falls down into the second stirring path 84B. In this way, the developer G after developing does not flow into the first stirring path 84A, and an imbalance in the amounts of the developer G that exist in the first stirring path 84A and the second stirring path 84B is suppressed.

Note that the present invention is not limited to the above-described exemplary embodiments.

A plurality of the second opening portions 88 may be formed in the partitioning wall 86 in the form of slits. Further, the shape of the second opening portion 88 is not limited to rectangular, and may be polygonal such as rectangular or the like, or may be round.

The position where the reduced diameter portion 81A is formed is not limited to the central portion of the image forming unit 12, and may be formed at either the upper portion or the lower portion in accordance with the outer shape of the image forming unit 12. Further, the shape of the wall portion 86B of the partitioning wall 86 is not limited to being bent in a substantial inverted-V-shape, and may be projected-out in a rectangular shape or bent into a circular arc shape.

Further, the present invention is not limited to a two-component developing method developing device, and can also be applied to developing devices that use a magnetic single component or non-magnetic single component developing method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer housing chamber in which developer is housed;

a developer holding member holding developer by magnetic force;

a partitioning wall that is a portion of a separating wall of the developer housing chamber and is provided between the developer housing chamber and the developer holding member, the partitioning wall having an overlapping region that, in a transparent plan view, is positioned upward of the developer holding member and overlaps the developer holding member in an up/down direction; and an opening portion formed in the overlapping region of the partitioning wall.

2. The developing device of claim 1, wherein the developer holding member has:

magnetic field generating member provided with a developing magnetic pole portion that faces an image holding body and holds developer, a conveying magnetic pole portion that is a different polarity than the developing magnetic pole portion and draws developer of the developing magnetic pole portion, and a peeling magnetic pole portion that is a same polarity as the developing magnetic pole portion and peels-off developer that is drawn to the conveying magnetic pole portion; and a rotating body that is tubular and is provided rotatably at a periphery of the magnetic field generating member, and at whose outer peripheral surface developer is held on or is peeled-off from, and the opening portion is positioned so as to oppose a region from the conveying magnetic pole portion to the peeling magnetic pole portion.

3. The developing device of claim 2, wherein the opening portion is provided at a region where magnetic flux density of the peeling magnetic pole portion is highest.

4. The developing device of claim 1, wherein an internal region of the opening portion is positioned partially within the overlapping region.

5. The developing device of claim 1, wherein the developer holding member is provided at a developing chamber, and a wall portion of the partitioning wall, which wall portion is at a lower side of the opening portion, is bent toward a direction of gravity more than an angle of inclination of a wall portion that is at an upper side of the opening portion.

6. The developing device of claim 5, wherein the bent wall portion of the partitioning wall, which wall portion is at the lower side of the opening portion, is substantially inverted-V-shaped.

7. The developing device of claim 1, wherein the developer holding member is provided at a developing chamber, and a wall portion of the partitioning wall, which wall portion is at a lower side of the opening portion, is rectilinear.

8. The developing device of claim 1, wherein a side wall of the developer housing chamber, which side wall opposes the partitioning wall, is bent toward an inner side of the developer housing chamber, and a reduced diameter portion where a sectional surface area of the developer housing chamber is reduced is formed.

9. The developing device of claim 1, wherein a lower edge portion of the opening portion is disposed further upward than a rotational center of the developer holding member.

10. The developing device of claim 1, wherein the opening portion is sealed by a sealing member that can be removed.

11. An image forming device comprising a plurality of image forming units, each of which has the developing device of claim 1 and makes a latent image visible by the developing device, wherein the image forming units that are adjacent overlap in an up/down direction at positions of the developer housing chambers.

* * * * *